US009763016B2

(12) United States Patent
Merks et al.

(10) Patent No.: US 9,763,016 B2
(45) Date of Patent: Sep. 12, 2017

(54) AUTOMATIC DIRECTIONAL SWITCHING ALGORITHM FOR HEARING AIDS

(71) Applicant: Starkey Laboratories, Inc., Eden Prairie, MN (US)

(72) Inventors: Ivo Merks, Eden Prairie, MN (US); John Ellison, St. Louis Park, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 14/808,486

(22) Filed: Jul. 24, 2015

(65) Prior Publication Data

US 2016/0037268 A1 Feb. 4, 2016

Related U.S. Application Data

(60) Provisional application No. 62/031,497, filed on Jul. 31, 2014.

(51) Int. Cl.

*H04R 25/00* (2006.01)
*G10L 21/0208* (2013.01)
*G10L 21/0216* (2013.01)

(52) U.S. Cl.

CPC ..... *H04R 25/40* (2013.01); *G10L 21/0208* (2013.01); *H04R 25/43* (2013.01); *H04R 25/505* (2013.01); *G10L 2021/02166* (2013.01); *H04R 2225/43* (2013.01); *H04R 2410/01* (2013.01)

(58) Field of Classification Search

CPC .. H04R 25/40; H04R 25/552; H04R 2410/01; H04R 25/43; H04R 25/505; H04R 3/005; H04R 2225/43; G10L 21/0216; G10L 21/0208; G10L 2021/02166

USPC ..... 381/313, 92, 314, 11, 119

See application file for complete search history.

(56) References Cited

U.S. PATENT DOCUMENTS

| | | | |
|---|---|---|---|
| 5,524,056 | A | 6/1996 | Killion et al. |
| 5,757,933 | A | 5/1998 | Preves et al. |
| 6,704,422 | B1 | 3/2004 | Jensen |
| 6,882,736 | B2 | 4/2005 | Dickel et al. |
| 7,116,792 | B1 | 10/2006 | Taenzer et al. |
| 7,181,033 | B2 | 2/2007 | Fischer et al. |
| 7,209,568 | B2 | 4/2007 | Arndt et al. |
| 7,324,649 | B1 | 1/2008 | Knapp et al. |
| 7,330,557 | B2 | 2/2008 | Fischer |

(Continued)

FOREIGN PATENT DOCUMENTS

| | | | |
|---|---|---|---|
| EP | 0664071 | A1 | 7/1995 |
| EP | 1723827 | A2 | 11/2006 |

(Continued)

OTHER PUBLICATIONS

"European Application Serial No. 15179091.2, Extended European Search Report mailed Nov. 20, 2015", 15 pgs.

(Continued)

*Primary Examiner* — Davetta W Goins

*Assistant Examiner* — Phylesha Dabney

(74) *Attorney, Agent, or Firm* — Schwegman Lundberg & Woessner, P.A.

(57) ABSTRACT

Described herein is a technique by which a hearing may automatically switch between a directional microphone mode and an omnidirectional microphone mode base upon an estimate of the noise floor as derived from the input signal. A minimum statistics estimator may be used to estimate the noise floor.

10 Claims, 4 Drawing Sheets

(56) References Cited

U.S. PATENT DOCUMENTS

| | | | | |
|---|---|---|---|---|
| 7,590,253 | B2 | 9/2009 | Killion | |
| 7,929,721 | B2 | 4/2011 | Knapp et al. | |
| 8,068,627 | B2 * | 11/2011 | Zhang | H04R 25/405 381/313 |
| 8,358,789 | B2 * | 1/2013 | Fischer | H04R 25/407 381/92 |
| 2007/0217629 | A1 | 9/2007 | Zhang et al. | |
| 2009/0304187 | A1 | 12/2009 | Dittberner et al. | |
| 2012/0213395 | A1 * | 8/2012 | Rosenkranz | H04R 25/00 381/317 |
| 2014/0198934 | A1 * | 7/2014 | Recker | H04R 25/407 381/313 |

FOREIGN PATENT DOCUMENTS

| | | | | |
|---|---|---|---|---|
| EP | 2328363 | A1 * | 6/2011 | G10L 25/78 |
| EP | 2981100 | A1 * | 2/2016 | H04R 25/505 |
| WO | WO 9424834 | A1 * | 10/1994 | H04R 25/407 |
| WO | WO-2007096247 | A1 | 8/2007 | |
| WO | WO 2007098768 | A1 * | 9/2007 | H04R 25/40 |

OTHER PUBLICATIONS

Martin, Rainer, "Noise power spectral density estimation based on optimal smoothing and minimum statistics", IEEE Transactions on Speech and Audio Processing., vol. 9, No. 5, (Jul. 31, 2001), 504-512.

Rangachari, S, et al., "A noise-estimation algorithm for highly non-stationary environments", Speech Communication, Elsevier Science Publishers, Amsterdam, NL, vol. 48, No. 2, (Feb. 1, 2006), 220-231.

* cited by examiner

AUTOMATIC DIRECTIONAL SWITCHING ALGORITHM FOR HEARING AIDS

PRIORITY APPLICATION

This application is claims the benefit under 35 U.S.C. 119(e) to U.S. Provisional Application No. 62/031,497, filed on 31 Jul. 2014; which application is incorporated herein by reference in its entirety.

FIELD OF THE INVENTION

This invention pertains to electronic hearing aids and methods for their use.

BACKGROUND

Hearing aids are electroacoustic device which amplify sound for the wearer in order to correct hearing deficits as measured by audiometry, usually with the primary purpose of making speech more intelligible. Many hearing aids may be operated in either an omnidirectional or a directional microphone mode, which refers to manner in which the hearing aid's microphone or microphones pick up sound. In an omnidirectional microphone mode, sound is picked up from all directions around the wearer and amplified. In a directional microphone mode, sound is preferentially picked up and amplified from only a single direction, usually in front of the listener. Usually, the omnidirectional microphone mode is used in quiet listening situations because speech often comes from directions other than in front of the listener. The directional microphone mode, on the other hand, may be used in noisy listening situations to enhance the sound coming from someone speaking directly to the hearing aid wearer. Described herein are techniques for automatically switching between omnidirectional and directional microphone modes.

DETAILED DESCRIPTION

Figure 1:
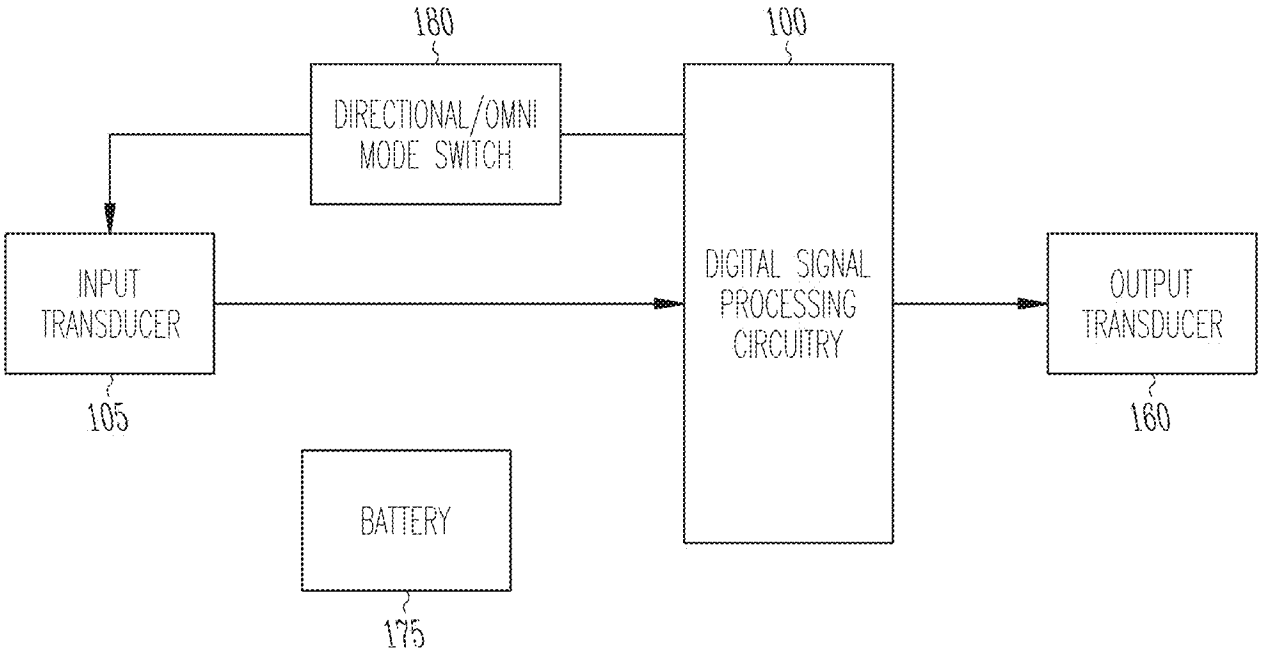
FIG. 1 shows the basic electronic components of an example hearing aid.

FIG. 1 illustrates the basic functional components of an example hearing aid. Hearing aids are devices that compensate for hearing losses by amplifying sound whose electronic components include a microphone for receiving ambient sound, an amplifier for amplifying the microphone signal in a manner that depends upon the frequency and amplitude of the microphone signal, a speaker for converting the amplified microphone signal to sound for the wearer, and a battery for powering the components. The electronic circuitry of the hearing aid is contained within a housing that may be placed, for example, in the external ear canal or behind the ear. An input transducer 105 receives sound waves from the environment and converts the sound into an input signal. After amplification by a pre-amplifier, the input signal is sampled and digitized to result in a digitized input signal that is passed to digital signal processing (DSP) circuitry 100. The DSP circuitry processes the digitized input signal into an output signal in a manner that compensates for the patient's hearing deficit (e.g., frequency-specific amplification and compression). The output signal is then converted to analog form and passed to an audio amplifier that drives a speaker 160 (a.k.a. a receiver) to convert the output signal into an audio output. A battery 175 supplies power for the electronic components.

The DSP circuitry 100 may be implemented in a variety of different ways, such as with an integrated digital signal processor or controller or with a mixture of discrete analog and digital components. For example, the signal processing may be performed by a mixture of analog and digital components having inputs that are controllable by the controller that define how the input signal is processed, or the signal processing functions may be implemented solely as code executed by the controller. The terms "controller," "module," or "circuitry" as used herein should therefore be taken to encompass either discrete circuit elements or a processor executing programmed instructions contained in a processor-readable storage medium.

The input transducer 105 may comprise one or more microphones and may be operated in either an omnidirectional or directional microphone mode as controlled by the omni/directional switch 180 operated by the DSP circuitry 100. The switch 180 may be a separate hardware component or may be incorporated into the DSP 100. In various embodiments, the input transducer 105 may comprise an array of microphones that may be operated directionally or omnidirectionally, a single microphone that may be operated in either a directional or omnidirectional mode, or separate omnidirectional and directional microphones. The DSP circuitry may then control which mode the hearing aid is to operate in based upon received ambient sound.

The information in the input signal that a hearing aid may use to determine switching behavior between omnidirectional and directional microphone modes may include the level, modulation, or frequency characteristics of the input signal. Ideally, a hearing aid should switch to a directional microphone mode when the environment becomes challenging for speech intelligibility or, in other words, when the environmental noise level increases such that it conflicts with speech. This may be determined by comparing the level of the speech signal to the noise level (i.e., the signal-to-noise ratio or SNR), or more simply, by comparing the average input level to a specified level. Described herein is a technique for automatic directional switching algorithm based upon a measure of the noise level alone.

Figure 2:
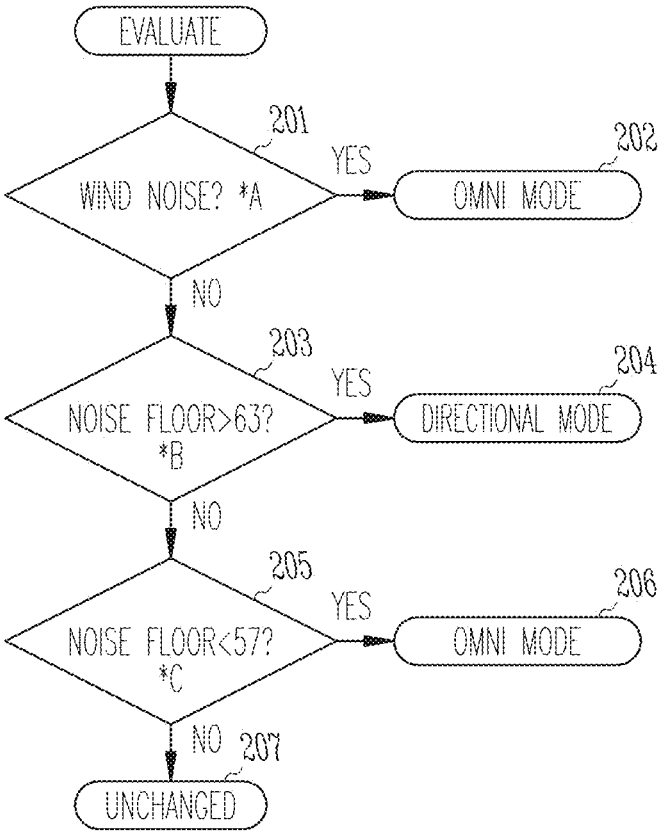
FIG. 2 illustrates an example mode switching algorithm

FIG. 2 illustrates an example algorithm that may be performed by the DSP circuitry 100 in order to control switching between the omnidirectional and directional microphone modes. When triggered to do so (e.g., by a user input, input level change, or timer expiration), the DSP circuitry begins evaluation of current conditions at block 200 and measures the current noise level in the input signal. At block 201, a check is made for presence of wind noise based upon characteristics of the input signal. If wind noise is present, the device switches to omnidirectional mode at block 202. If no wind noise is present, the device compares the measured noise floor to an upper threshold value (e.g., 63 dB) at block 203 and switches to a directional microphone mode at block 204 if the noise floor exceeds the upper threshold value. If the noise floor is less than the upper threshold value, the device compares the noise floor to a lower threshold value (e.g., 57 dB) at block 205. If the noise floor is below the lower threshold value, the device switches to the omnidirectional mode at block 206. If the noise floor is neither above the upper threshold nor below the lower threshold, the current operating microphone mode is left unchanged at block 207. The use of upper and lower threshold values provides hysteresis in switching between the two modes in order to prevent repeated switching when the noise floor is near one of the thresholds.

One method for achieving an accurate and reliable measurement of the noise level uses minimum statistics to estimate the noise floor of an input signal. This method estimates the minimum level over a specified interval of time to measure the noise floor rather than the average level to calculate a noise estimate. The basic idea is that the minimum of the noise power over a sufficiently long time period can be considered as an estimation of the noise power because, in silent periods, the noisy signal power decreases to the noise power. Since there exist short silence periods between syllables and words, this method may track the noise power even in while speech is taking place. The advantage of minimum statistics for mode switching is that within a level-only based switching approach, a high-level speech signal in a quiet environment will not cause a system to switch to a directional microphone mode so long as the noise level estimate required for switching is set in the approximate region as the average speech level. Conversely, the system will switch to a directional microphone mode when the noise interferes with the speech signal. The use of minimum statistics in noise level estimation is thus relatively resistant to the presence of speech.

An example embodiment for measuring the noise floor using minimum statistics comprises the following. The digitized input signal is first input to a weighted overlap-add (WOLA) filter bank in order to extract components of the input signal in a frequency range of interest. Other embodiments may employ an FFT (fast Fourier transform) operation to extract the components. In this embodiment, the frequency range of interest is 500 to 2500 Hz. The powers of the extracted frequency components are then summed and smoothed with a first order recursion filter. The amplitude of the smoothed power signal is then measured over a specified time period (e.g., 4 seconds). The minimum value of the smoothed power signal found during the time period is used as the current estimate of the noise floor.

The following is a description of the operation of a minimum statistics noise estimator according to the embodiment just described. The estimator tracks the minimum of the input signal for a specified period of time (typically 2 or 4 seconds) and uses this minimum as the noise estimate for the next period (while tracking the minimum at the same time). The algorithm has no threshold to tune and is therefore very robust in all kind of noise conditions. Because the minimum statistics rarely over-estimates the noise, it is very suitable for controlling switching between directional and omnidirectional microphone modes.

Figure 3:
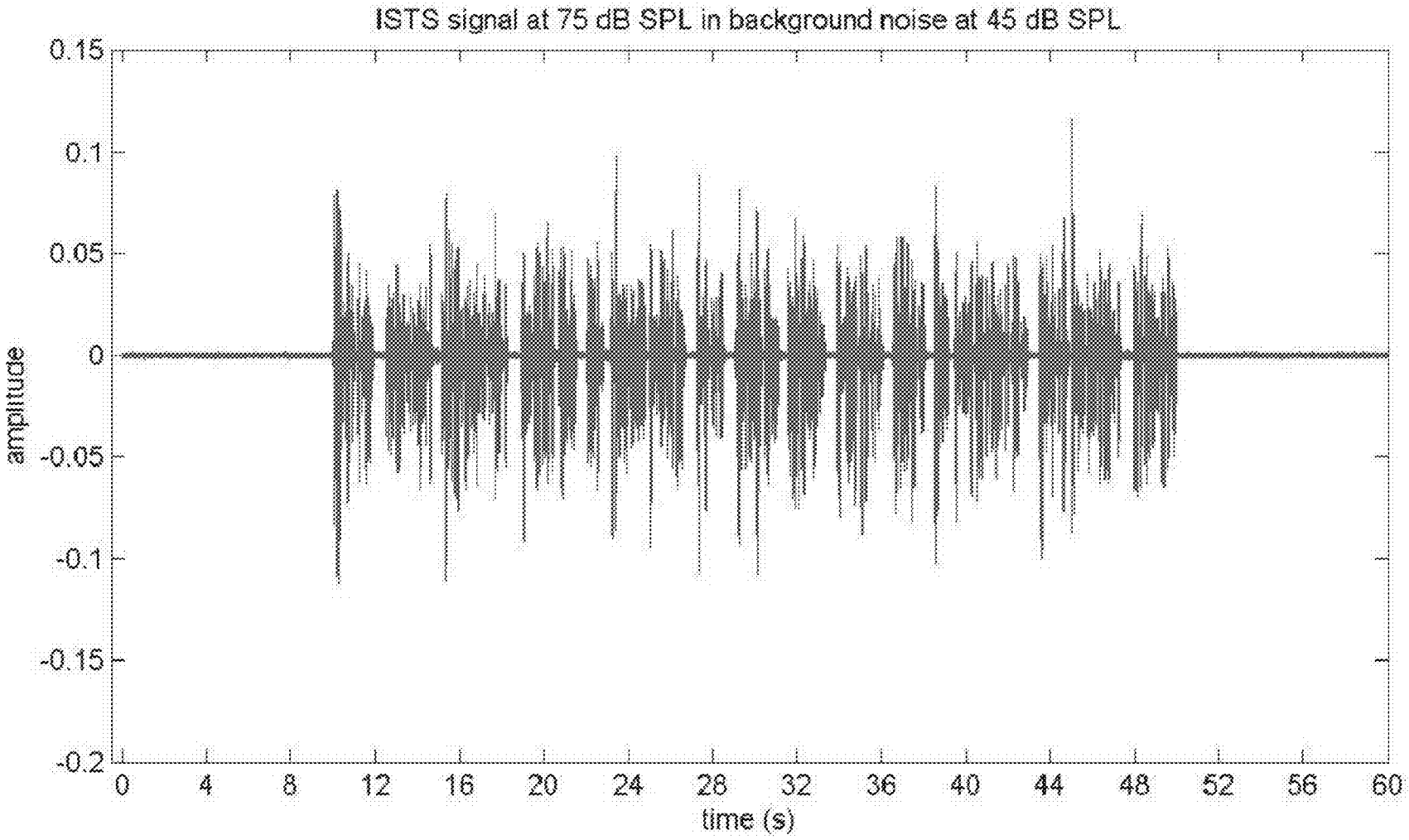
FIG. 3 illustrates a time domain input signal.
Figure 4:
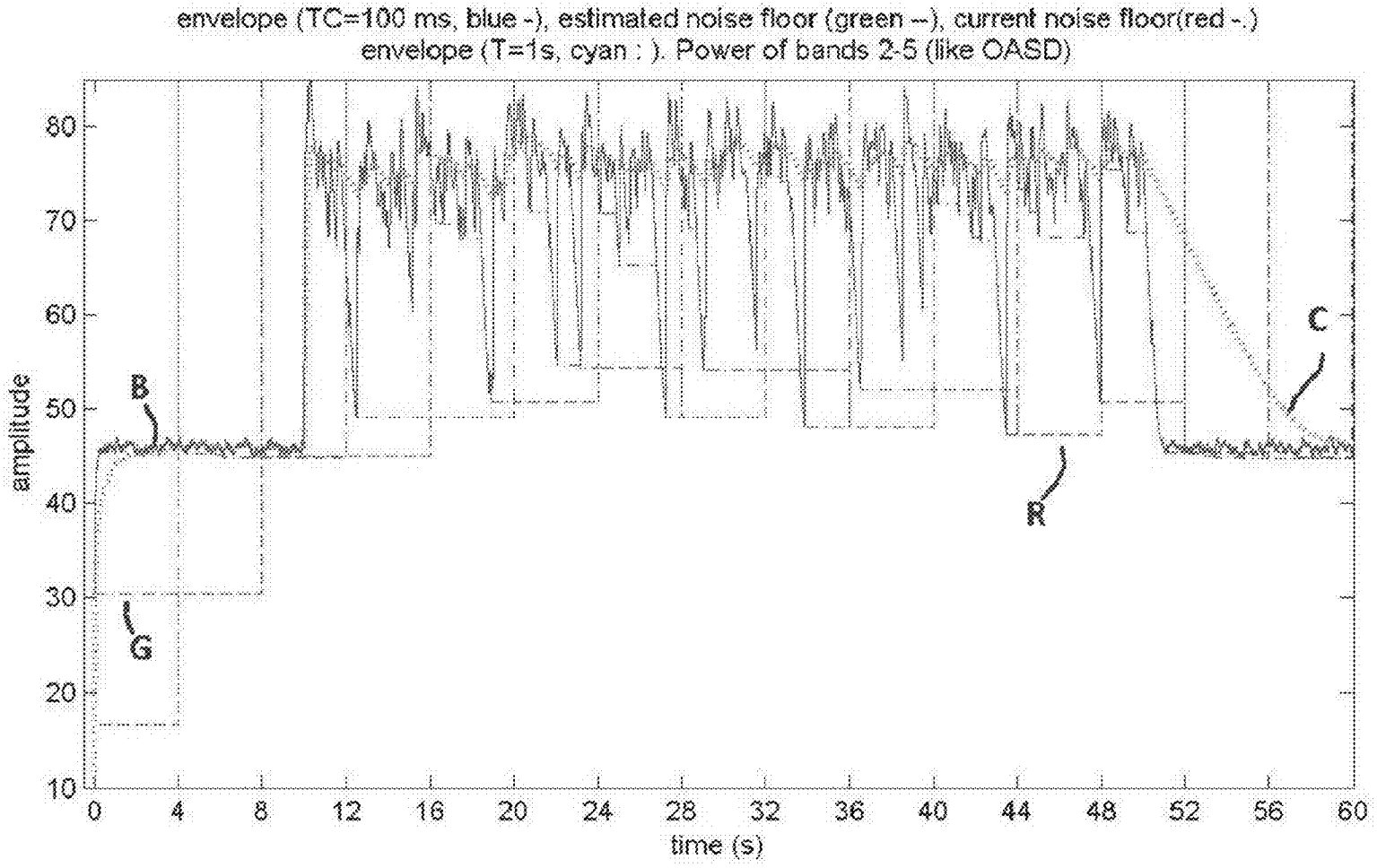
FIG. 4 illustrates the variables derived by the minimum statistics noise estimator.

FIG. 3 illustrates a test waveform in the time domain made up of an international speech test signal (ISTS) at 75 dB SPL and background noise at 45 dB SPL (e.g., a quiet room). The ISTS signal starts at t=10 s and stops at t=50 s. FIG. 4 illustrates the variables derived from the test waveform by the minimum statistics estimator as depicted by lines labeled B, G, R, and C. The B line shows the first order recursion smoothing (using a time constant of 0.1 s) of the sum of the WOLA-bands from the WOLA filter bank. The G line is the estimated noise floor from minimum statistics applied to the current 4-second time period. The R line represents the current noise floor being used to control mode switching. The C line represents first order recursion smoothing (with a time constant of 1 s) of the sum of the WOLA bands.

At t=0 s, the algorithm is initialized and it starts the estimation. The B and C lines represent the output of the first order recursion filters having time constants of 0.1 seconds and 1 second, respectively. The G line is the estimate of the noise floor and it tracks the minimum of the B line. The R line is the current noise floor and it is the value that is currently used the mode switching algorithm. At t=4 s, the value of the estimated noise floor (G line) is copied to the current noise floor estimate (R line) which is then used in the switching algorithm. Subsequently, the estimated noise floor (G line) is reset to a very high value and the estimated noise floor (G line) starts tracking the minimum value of the B line again. At t=8 s, the value of the estimated noise floor (G line) is close to the actual noise floor (45 dB) and at that timeslot, it is copied to the current noise floor (R line). So from a re-boot, it takes 8 s to get a valid value in the current noise floor. At t=10 s, the speech starts and the level estimate illustrated by the C line goes quickly to the average level of 75 dB. The noise floor estimate tracks the minimum of the B line and tracks the minimum between speech pauses.

Since the ISTS-signal is a very dense signal, the B line does not always reach the actual noise level (45 dB) in speech pauses. Its highest estimate is 54 dB, and this value is 9 dB above the actual noise level. The threshold of the switching algorithm is typically 60 dB or higher, so this bias may not trigger the switching algorithm. Several options may be applied to reduce the bias. One option is to increase the period of the noise estimate from 4 seconds to a longer time period in order to increase the likelihood that the noise estimator would find the actual noise floor. Another option is to lower the smoothing time constant from 0.1 seconds to a smaller value. The B line in FIG. 4 would then decay more quickly to the actual noise floor. The effectiveness of this measure may be limited by the reverberation time in the room, because the reverberation in the room will also influence the steepness of the decay. Another option is to smooth the current noise floor value over time. This would limit the outliers in the estimate, but it may cause errors in the estimate to be present for a longer period of time. Another option is to immediately copy the estimated noise floor to the current noise floor if the value of the estimated noise floor is less than the current noise floor.

Example Embodiments

In an example embodiment, a hearing aid, comprises: an input transducer for converting an audio input into an input signal, wherein the input transducer may be operated in either an omnidirectional or directional mode; a digital signal processor (DSP) for processing the input signal into an output signal in a manner that compensates for a patient's hearing deficit; an audio amplifier and speaker for converting the output signal into an audio output; wherein the DSP is configured to: derive an current noise floor from the input signal; operate the input transducer in a directional mode if the current noise floor is greater than an upper threshold value; and, operate the input transducer in an omnidirectional mode if the current noise floor is less than a lower threshold value.

The DSP may be configured to estimate the noise floor from the minimum input signal power observed over a specified time period. The DSP may be configured to: extract a plurality of frequency components of the input signal in a specified frequency range; compute the powers of the extracted frequency components and sum the computed powers to result in an input power signal; compute an estimated noise floor as the minimum value of the input power signal over a specified time period; and equate the current noise floor to estimated noise floor. The DSP may be configured to extract the plurality of frequency components of the input signal in the frequency domain using a fast Fourier transform. The DSP may be configured to extract the plurality of frequency components of the input signal in the time domain using a filter bank. The DSP may be configured to compute the powers of the extracted frequency components in discrete time windows within the specified period of time. The DSP may be configured to smooth the input power signal prior to determining the minimum. The DSP may be configured to smooth the input power signal using a first order recursion filter.

The DSP may be configured to estimate the noise floor at the end of each time interval having a duration equal to the specified period of time by finding the minimum value of the input signal power during the time interval; and equate the current noise floor to the estimated noise floor at the end of each time interval. The DSP may be configured to estimate the noise floor at the end of each time interval having a duration equal to the specified period of time by finding the minimum value of the input signal power during the time interval; and equate the current noise floor to the estimated noise floor at the end of each time interval but equate current noise floor to a value of the input signal power before the end of the time interval if that value is less than the current noise floor. The DSP may be configured to filter the value of the current noise floor used to control switching between the directional microphone mode and the omnidirectional microphone mode with a smoothing filter.

Hearing assistance devices typically include an enclosure or housing, a microphone, hearing assistance device electronics including processing electronics, and a speaker or receiver. It is understood that in various embodiments the microphone is optional. It is understood that in various embodiments the receiver is optional. Such devices may include antenna configurations, which may vary and may be included within an enclosure for the electronics or be external to an enclosure for the electronics. Thus, the examples set forth herein are intended to be demonstrative and not a limiting or exhaustive depiction of variations.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the wearer.

It is understood that digital hearing aids include a processor. In digital hearing aids with a processor programmed to provide corrections to hearing impairments, programmable gains are employed to tailor the hearing aid output to a wearer's particular hearing impairment. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing aid, comprising:

an input transducer for converting an audio input into an input signal, wherein the input transducer may be operated in either an omnidirectional or directional mode;

a digital signal processor (DSP) for processing the input signal into an output signal in a manner that compensates for a patient's hearing deficit;

an audio amplifier and speaker for converting the output signal into an audio output;

wherein the DSP is configured to:

extract a plurality of frequency components of the input signal in a specified frequency range either in the frequency domain using a Fourier transform or in the time domain using a filter bank;

compute the powers of the extracted frequency components and sum the computed powers to result in an input power signal;

compute an estimated noise floor as the minimum value of the input power signal over a specified time period;

equate a current noise floor to the estimated noise floor at the end of a time interval of specified duration unless the estimated noise floor during the time interval is less than the current noise floor in which case the current noise floor is equated to the estimated noise floor before the end of the time interval;

operate the input transducer in a directional mode if the current noise floor is greater than a specified upper threshold value; and, operate the input transducer in an omnidirectional mode if the current noise floor is less than a specified lower threshold value.

2. The hearing aid of claim 1 wherein the powers of the extracted frequency components are computed in discrete time windows within the specified time period.

3. The hearing aid of claim 1 wherein the DSP is configured to smooth the input power signal prior to determining the minimum.

4. The hearing aid of claim 3 wherein the DSP is configured to smooth the input power signal using a first order recursion filter.

5. The hearing aid of claim 1 wherein the DSP is configured to filter the value of the current noise floor used to control switching between the directional microphone mode and the omnidirectional microphone mode with a smoothing filter.

6. A method for operating a hearing aid, comprising:

extracting a plurality of frequency components of the input signal in a specified frequency range either in the frequency domain using a Fourier transform or in the time domain using a filter bank;

computing the powers of the extracted frequency components and sum the computed powers to result in an input power signal;

computing an estimated noise floor as the minimum value of the input power signal over a specified time period;

equating a current noise floor to the estimated noise floor at the end of a time interval of specified duration unless the estimated noise floor during the time interval is less than the current noise floor in which case the current noise floor is equated to the estimated noise floor before the end of the time interval;

operating a microphone in a directional mode if the current noise floor is greater than a specified upper threshold value; and, operating the microphone in an omnidirectional mode if the current noise floor is less than a specified lower threshold value.

7. The method of claim 6 wherein the powers of the extracted frequency components are computed in discrete time windows within the specified time period.

8. The method of claim 6 further comprising smoothing the input power signal prior to determining the minimum.

9. The method of claim 8 further comprising smoothing the input power signal using a first order recursion filter.

10. The method of claim 6 further comprising filtering the value of the current noise floor used to control switching between the directional microphone mode and the omnidirectional microphone mode with a smoothing filter.

* * * * *